US005450183A

United States Patent [19]

O'Leary

[11] Patent Number: 5,450,183

[45] Date of Patent: Sep. 12, 1995

[54] IMAGE FORMING APPARATUS AND METHOD FOR PRODUCING HIGH GLOSS DUPLEX IMAGES

[75] Inventor: Kevin J. O'Leary, Rochester, N.Y.

[73] Assignee: Eastman Kodak Company, Rochester, N.Y.

[21] Appl. No.: 917,654

[22] Filed: Jul. 23, 1992

[51] Int. Cl.[6] ..... G03G 15/20

[52] U.S. Cl. ..... 355/285; 355/319; 355/326 R

[58] Field of Search ..... 355/285, 289, 290, 295, 355/319, 326-328; 219/216, 469, 470; 432/59, 60; 430/99; 118/60

[56] References Cited

U.S. PATENT DOCUMENTS

| | | | |
|---|---|---|---|
| 4,019,024 | 4/1977 | Namiki | 219/469 |
| 4,370,047 | 1/1983 | Damouth et al. | 355/327 |
| 4,429,990 | 2/1984 | Tamary . | |
| 4,430,406 | 2/1984 | Newkirk et al. | 430/99 |
| 4,453,841 | 6/1984 | Bobick et al. | 400/126 |
| 4,515,884 | 5/1985 | Field et al. | 430/99 |
| 5,040,029 | 8/1991 | Rodenberg et al. | 355/271 |
| 5,051,780 | 9/1991 | Stelter et al. | 355/208 |

*Primary Examiner*—R. L. Moses

*Attorney, Agent, or Firm*—Leonard W. Treash, Jr.

[57] ABSTRACT

High gloss is provided for multicolor images formed on opposite sides of a receiving sheet in a double pass system using a fuser having a smooth, soft pressure roller surface. Preferably, a thin elastomeric outer layer on the pressure roller has a shore Å durometer less than 40 and a roughness average less than 40 microinches. When a second multicolor image is fused to a receiving sheet by contact with a fusing roller, the gloss of a first multicolor image on the opposite side of the receiving sheet that has already been fused is not reduced by contact with the pressure roller, but is, in fact, enhanced.

20 Claims, 2 Drawing Sheets

IMAGE FORMING APPARATUS AND METHOD FOR PRODUCING HIGH GLOSS DUPLEX IMAGES

This invention relates to the production of duplex toner images, especially duplex toner images with a high gloss. Although not limited thereto, it is particularly usable in making duplex color images having high gloss.

The amount of gloss produced in dry electrophotographic image forming methods is determined by a number of parameters, most of them associated with either the characteristics of the toner or the fuser. With a given toner, it is known that gloss can be increased by increasing temperature, nip size, dwell time and pressure in a roller fuser. It is also known that the smoother a fusing roller (the roller touching the image during fusing) the higher the gloss.

Early roller fusers employed a polytetrafluoroethylene-covered metal fusing roller with a softer pressure roller. This configuration gives good heat transfer to the image from the metal fusing roller and generally provides a somewhat glossy fused image. More recently, single-color fusers have preferred a softer fusing roller, for example, a roller made of a silicone rubber elastomer which has good release characteristics and provides a "matte" finish, which is more desirable in text material. In such apparatus the pressure roller is commonly hard. A hard pressure roller provides a nip curvature into the fusing roller which causes the beam strength of the receiving sheet to assist in separating the image side of the receiver from the fusing roller. Roller fusers with silicone rubber elastomers on both rollers are also known. See, for example, U.S. Pat. No. 4,019,024 in which the two rollers are identical and U.S. Pat. No. 4,515,884.

Duplex fusers which fuse both images are also known, see, for example, U.S. Pat. Nos. 4,429,990 and 5,051,780 in which a silicone robber elastomer is applied to each roller, and each roller is heated in order to fuse images on both sides of a receiving sheet at the same time. These two patents show interesting contrast. U.S. Pat. No. 4,429,990 shows a fuser, used commercially, in which the "simplex" roller contacting the side of the sheet carrying simplex images is softer than the "duplex" roller, primarily to provide better release characteristics when doing simplex. U.S. Pat. No. 5,051,780 shows a fuser in which the simplex roller is harder than the duplex roller to provide better heat transfer to the simplex images which come at twice the rate of duplex images.

U.S. Pat. No. 5,040,029 to Rodenberg et al, issued Aug. 13, 1991, shows a multicolor image forming apparatus in which as many as four different color toner images are created in series on an image member and transferred in registration to one side of a receiving sheet to form a first multicolor image. The receiving sheet is run through a roller fuser to fix the first multicolor image and the receiving sheet is recirculated back to the image member to receive a second multicolor image on the opposite side. The receiving sheet is fed back through the fuser to fix the second multicolor image, creating fixed duplex multicolor images.

There are apparatus presently on the market which produce duplex multicolor images. However, these apparatus are primarily copiers or printers doing what is commonly known as accent color in which a high gloss for both images is not required.

SUMMARY OF THE INVENTION

In apparatus of the type shown in the above-mentioned Rodenberg et al patent, the first multicolor image formed must pass through the fuser twice. The second time through the fuser it must contact the pressure roller while the second multicolor image is being fused. I have found it difficult in such apparatus to obtain high gloss on the first multicolor image with conventional fusing apparatus.

Accordingly, it is an object of the invention to provide a method and apparatus generally of the type in which a first image is formed on a first side of a receiving sheet and that image is fused and, thereafter, a second image is formed on a second side of the receiving sheet and that image is fused in which the gloss of at least the first image is improved.

This and other objects are accomplished by fusing the images with a fuser having a very smooth, relatively soft outer surface on the pressure roller.

According to a preferred embodiment, the smooth, relatively soft outside surface is formed by a very thin layer of an elastomer having a shore Å durometer of less than 40 and a roughness average less than 40 microinches (preferably, less than 20 microinches). For example, a polydimethylsiloxane having both titanium dioxide and silicon fillers, sold by Dow Coming, Inc. under the trademark Silastic E® has a durometer of 35 shore Å and a roughness average of about 10 microinches and provides excellent results in this application.

Using the invention, I have found that the gloss obtained on the first multicolor image during fusing is not appreciably reduced during the second pass of the receiving sheet through the fusing nip when the second multicolor image is being fused, but is, in fact, enhanced.

According to a further preferred embodiment, this same material is used for the outside surface of the fusing roller. Underlayers on both rollers are constructed such that the pressure roller is harder than the fusing roller to form a nip that provides good release of the receiving sheet with respect to the side contacting the fusing roller.

According to a further preferred embodiment, comparable gloss between images on opposite sides is obtained by fusing at a faster speed during the first pass than during the second pass.

Release of toner images without offset is more difficult with the multiple layers of toner that are fused in color imaging. Further, the higher quality desired in color imaging dictates that less fusing oil be used. This construction and materials provides excellent release of the images from both rollers with use of a relatively small amount of fusing oil.

BEST MODE OF CARRYING OUT THE INVENTION

Figure 1:
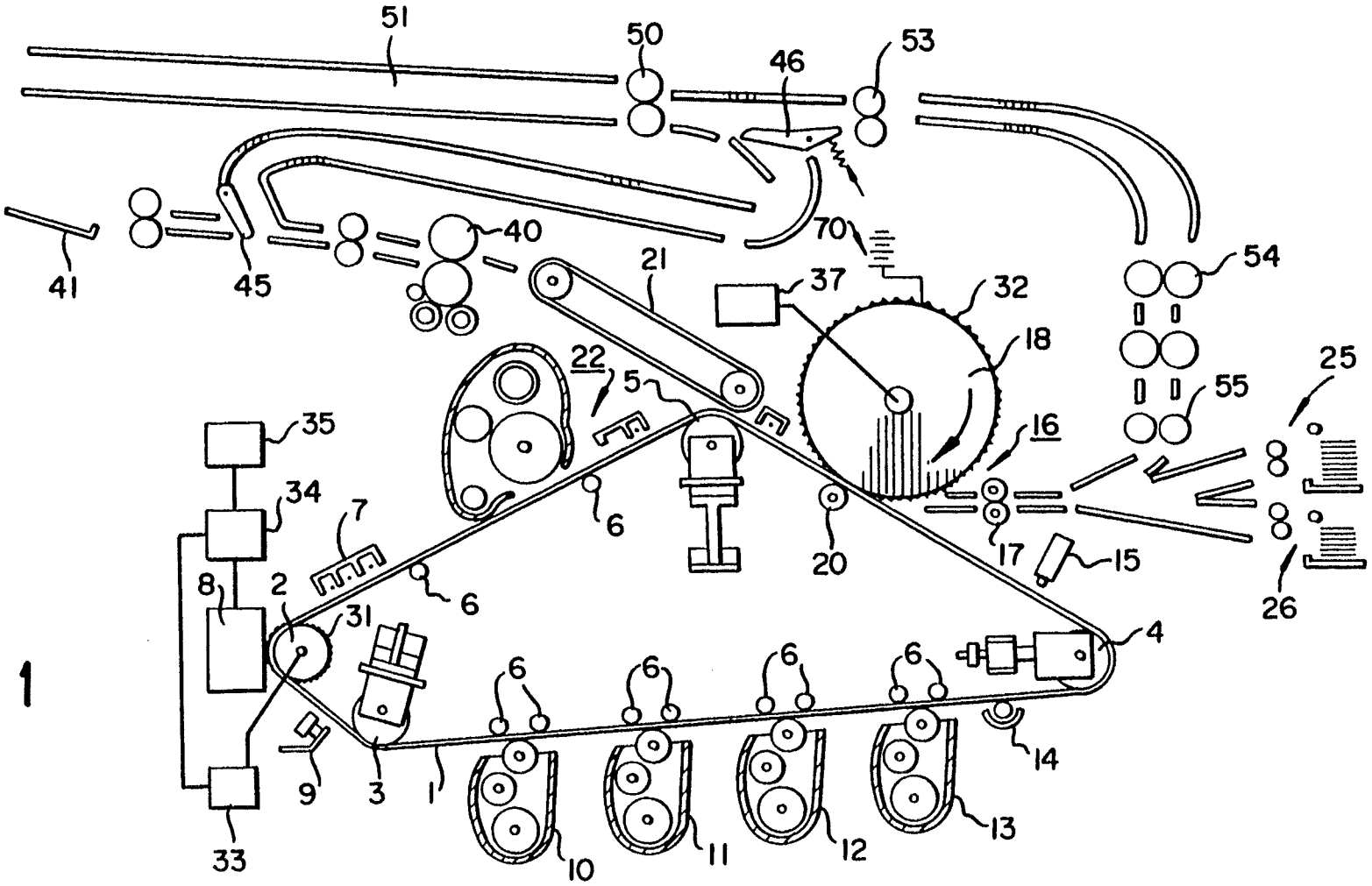
FIG. 1 is a schematic side view of a printer with many parts eliminated for clarity of illustration.

According to FIG. 1, a film core portion of an image forming apparatus, for example, a printer, includes an image member, for example, an endless photoconductive web 1, entrained about a series of primary rollers 2, 3, 4 and 5 and other supporting structure, for example, film skis 6.

Web 1 is driven through a series of electrophotographic stations generally well known in the an. More specifically, a uniform charge is laid down on web 1 by charging station 7. The uniformly charged web moves around printhead roller 2 which is directly opposite an LED printhead 8 which LED-printhead exposes the web 1 in a manner well known in the art. The web then moves into operative relation with an electrometer 9 which senses the level of charge existing after exposure of the web by printhead 8, to help control the process.

The web then moves into operative relation with a series of toning or developing stations 10, 11, 12 and 13. Each image created by printhead 8 is toned by one of the toning stations. After being toned, the web passes a magnetic scavenger 14 which removes excess iron particles picked up in the toning process. After the electrostatic image has been toned, the web passes under a densitometer 15 which measures the density of the toner image, also for use in controlling the process. The toner image then proceeds to a transfer station 16 where the image is transferred to a transfer surface of a receiving sheet carried by a transfer drum 18.

The transfer drum 18 includes means for securing the receiving sheet for repeated presentations to web 1. The transfer drum 18 cooperates with web 1 to incrementally bring the receiving sheet and the toner image into transfer relation so that the toner image is transferred to the receiving sheet. As is well known in the art, this is generally accomplished in the presence of an electric field created by biasing the transfer drum, for example, by an electrical source 70, compared to the conductive layer of the web 1 or to a backing roller 20 for the web.

When the apparatus is operating in a multi-image mode, for example, a multicolor mode, consecutive images or pairs of images are toned with different color toners using the different toning stations 10–13. These consecutive images are transferred in registry to the receiving sheet as it repeatedly is brought into transfer relation with the web 1 by the drum 18. After the transfer operation is complete, the receiving sheet is allowed to follow the web. The receiving sheet is separated from the web with the aid of an electrostatic sheet transport mechanism 21 and is transported to a fuser 40, which will be discussed in more detail with respect to FIG. 2. The web 1 is then cleaned by the application of a neutralizing corona and a neutralizing erase lamp and a magnetic brush cleaning mechanism, all located at a cleaning station 22.

The transfer drum 18 is driven by a motor 37. The drum 18, in turn, drives the web 1 through a sprocket 32 which engages perforations in web 1. Sprocket 32 also forms part of a registration and timing system which includes a sprocket 31 on printhead roller 2, which sprocket 31 is linked to an encoder 33. The encoder 33 feeds signals indicative of the angular position of sprocket 31 to a drive 34 for the printhead 8, which drive 34 times the application of information from an information source 35 to the printhead 8.

After the receiving sheet leaves the fuser 40, it can go directly to an output tray 41 or be deflected by deflector 35 into a duplex path according to the position of deflector 45, the position of which is controlled by the logic of the apparatus through means not shown. The duplex path moves the sheet by rollers and guides directing it first thorough a passive deflector 46 into turnaround rollers 50. Turnaround rollers 50 are independently driven to drive the receiving sheet into turnaround guide means 51 until the trailing edge thereof has been sensed by an appropriate sensor, not shown, to have passed passive diverter 46. Once the trailing edge has passed passive diverter 46, the turnaround rollers 50 are reversed and the receiving sheet is driven by rollers 50 and other sets of drive rollers 53 and 54 back to a position upstream of the transfer station 16. The receiving sheet can pass through registration mechanisms for correcting for skew, crosstrack misalignment and intrack misalignment and ultimately stop at alignment rollers 55.

Transfer station 16 receives sheets from any of three sources. First, it can receive sheets of one particular size from a first supply 25, which first supply may include, for example, letter-size sheets being fed with their short dimension parallel to the direction of feed. Second, it may receive sheets from a second supply 26, which, for example, may include ledger-size sheets with their long dimension parallel to the direction of feed. Third, transfer station 16 may receive sheets from the duplex path as controlled by rollers 55 which may include either size sheet and would already contain a fused image on its upper side. The receiving sheets, from whatever source, stop against timing roller 17. Response to a signal from the logic and control of the apparatus, not shown, timing rollers 17 accelerate to drive the receiving sheet into the nip between the transfer drum 18 and the web 1 as the first toner image to be transferred approaches the nip.

The duplex path is of a length that takes more than one sheet at one time, depending on the length of the sheets. For example, six letter-size sheets may be in the duplex path at one time or three ledger-size sheets. The printer can print different images on different sheets. The logic and control of the apparatus must supply the necessary programming to the exposure and toning stations so that the sheets ultimately fed to the output tray 41 are in the correct order considering the number of sheets that must be in the duplex path, and whether the output sheets are stacked faceup or facedown. Such programming is known in the art, see, for example, U.S. Pat. No. 4,453,841.

Using such an apparatus to do single color duplex reproductions and ordinary accent color duplex reproductions, adequate reproductions are accomplished with most prior art fusers. That is, conventional silicone robbers used for fusing dry toner images, electrophotographic copiers and laser printers provide a slightly matted finished which is not damaged by contacting the pressure roller or when the receiving sheet goes through the fuser the second time. For example, such fusers typically employ a pressure roller covered with a fluorinated polymer which does not adversely affect the matte finish first image while the second is being fused.

However, higher quality color images are enhanced by increased gloss. If the fusing roller is constructed of a material that provides a high gloss and the toner image is heated to a point that substantial flow is provided, the first image will be fused to a high gloss on leaving the nip in the first pass. However, when the second multicolor image is fused in the second pass of the receiving sheet through the fuser, the first multicolor image is also heated. With such heating, it can be adversely affected by the surface of the pressure roller and a somewhat matte finish applied to it. Pressure rollers covered with Teflon®, Viton® and Silverstone®, are relatively smooth but also are hard. I have found that the combination of pressure and heat utilized in such pressure rollers will leave the first image somewhat mottled and with a gloss substantially less than that of the second image in the finished product. This is certainly undesirable.

Figure 2:
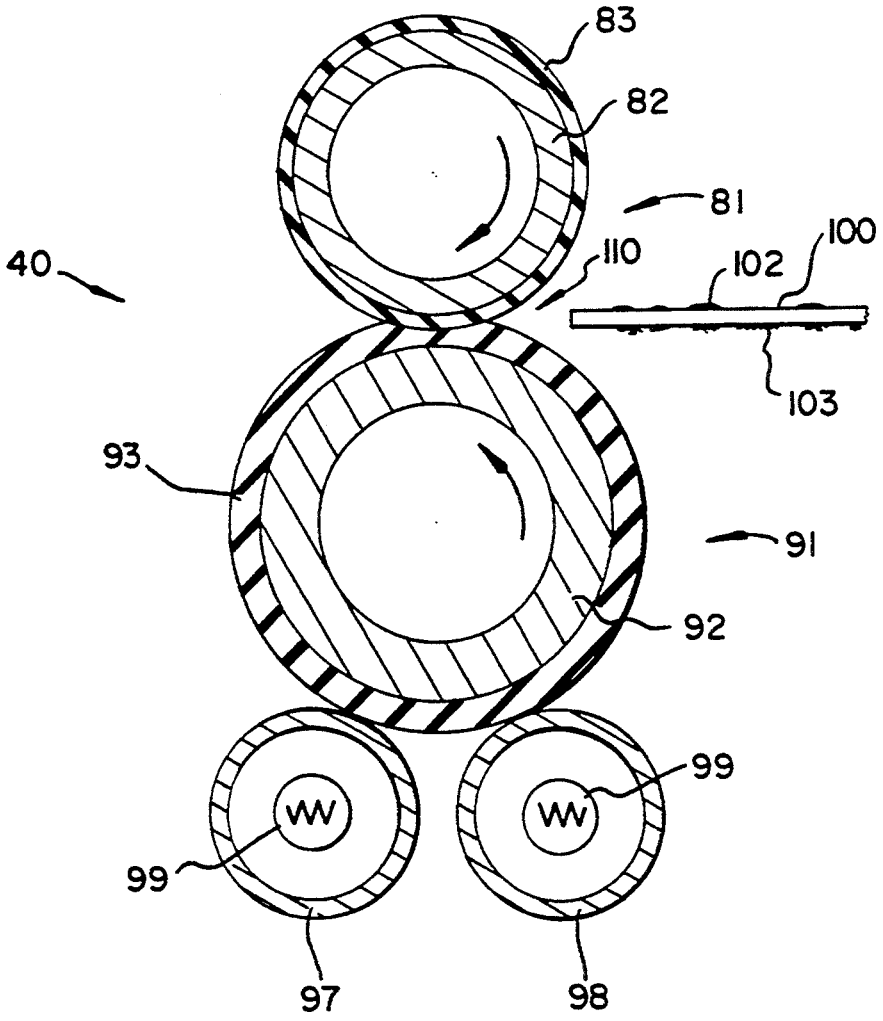
FIG. 2 is a side section of a fuser portion of the printer of FIG. 1.

According to FIG. 2, this problem is solved by a fuser adapted to do double pass, duplex, high gloss fusing. More specifically, fuser 40 includes a fusing roller 91 and a pressure roller 81. Fusing roller 91 includes a metallic corn 92 and a multilayered elastomeric covering 93. The outside surface of fusing roller 91 is heated by a pair of heating rollers 97 and 98 which are internally heated by lamps 99.

Pressure roller 81 includes a metal core 82 and a multilayer elastomeric covering 83.

A receiving sheet 100 is shown entering a nip 110 formed by rollers 81 and 91. Receiving sheet 100 includes an already fused first multicolor image 102 on a first side and an unfused loose, dry toner image 103 on a second; opposite side. The problem solved by this invention is to fuse multicolor toner image 103 to a high gloss without destroying the gloss of already fused toner image 102. As described below, the gloss of the first toner image 102 is actually enhanced by the second pass through the fuser shown in FIG. 2.

The elastomeric covering 93 for fusing roller 91 includes, next to metal core 92, a relatively thick thermally insulative elastomeric material such as Silastic J®, a polydimethylsiloxane having silica fillers and marketed by Dow Corning, Inc. A thin layer of a thermally conductive material such as EC4952, marketed by Emerson & Cuming is applied over the Silastic J to facilitate lateral heat transfer. A very thin oil-imperme, able layer is applied to the conductive layer and a very thin outside layer of Silastic E is applied on top of the oil-impermeable layer. For example, a 2.7 inch outside diameter fusing roller could include 0.188 inches of Silastic J, 0.020 inches of thermally conductive material, 0.001 inches of oil-impermeable material and 0.001 inches of Silastic E for a total elastomeric cover of 0.210 inches. The fusing roller 91 is externally heated, which makes a thermally insulative layer desirable. If fusing roller 91 is internally heated, all layers should be thermally conductive.

Preferably, the pressure roller elastomeric covering includes a somewhat thinner layer of, Silastic J, with the thin Silastic E outer layer separated from the Silastic J layer by another very thin oil-impermeable layer. For example, a 2.0 inch pressure roller can include 0.098 inches thick layer of Silastic J and 0.001 inches thick layers of oil-impermeable material and Silastic E for a total elastomeric covering thickness of 0.100 inches. With this construction, suitable loading provides a 0.5 inch nip curved into the fusing roller (for better paper release).

Thus, the outside surfaces of both rollers are made of a very thin layer of Silastic E, which is a polydimethylsiloxane having both titanium dioxide and silica fillers. Silastic E has a 35 shore Å durometer and can be coated to be quite smooth. This combination of softness and smoothness provides a high gloss when fusing each image with the fusing roller and further enhances the gloss of the first image by the pressure roller while the second image is being fused.

Preferably the Silastic E is solvent-coated on the oil-impermeable layer, which can, for example, be made of Viton or a similar material. Such coating produces a roughness average of about 10 microinches, peak-to-valley, although variation up to a roughness of 40 microinches provides acceptable gloss. A smoothness of less than 20 microinches, peak-to-valley, is preferred. By way of comparison, conventional silicone rubber for copier fusers generally have a roughness average of 100 or more microinches.

With comparable equipment, gloss levels in fusing are also dependent on toner viscosity and fusing speed. However, with conventional color toners, a gloss level of 10, as measured with a 20° gloss meter, is obtainable on toner image 102 at a speed of 4 inches per second using the fuser shown in FIG. 2. However, very good gloss is obtainable at faster speeds (and better gloss at still slower speeds). Because the second pass through the fuser actually enhances the gloss of image 102, it may be more glossy than image 103 which goes through once. To provide equal gloss, it is preferred to fuse the first image 102 on the first pass at a higher speed than the second pass. For example, uniform gloss is obtained with a first pass at 12 inches per second and a second pass at 6 inches-per second.

The Silastic E outer coating on the pressure roller is believed to provide high gloss to image 102 not only because of its smoothness, but also because of its compliance. Other smooth but harder materials (Viton, Teflon and Silverstone) do not provide the same gloss.

The Silastic E outer coating on both rollers also provides excellent release of the images without offset with a minimum use of fusing oil. The fusing oil is applied directly to the fusing roller by suitable means, not shown, and sufficient oil transfers to the pressure roller between images to prevent offset of image 102 to the pressure roller.

The invention has been described in detail with particular reference to a preferred embodiment thereof, but it will be understood that variations and modifications can be effected within the spirit and scope of the invention as described hereinabove and as defined in the appended claims.

I claim:

1. A method for producing duplex multicolor images on a receiving sheet, said method comprising:

forming a first multicolor toner image on a first side of the receiving sheet, passing the receiving sheet through a fusing nip formed by a heated fusing roller which contacts the first multicolor toner image and a pressure roller, which pressure roller has an outer surface formed by a layer of elastomeric material having a shore Å durometer less than 40 and a roughness average less than 40 microinches, then forming a second multicolor image on a second side of the receiving sheet, and fusing the second multicolor image by passing the receiving sheet through the fusing nip with the second multicolor image contacting the fusing roller and the first multicolor image contacting the pressure roller.

2. The method according to claim 1 wherein the elastomeric outer surface of the pressure roller is provided by a layer of a polydimethylsiloxane having titanium dioxide and silica fillers sufficient to provide a durometer of approximately 35 shore Å and a roughness average of about 10 microinches.

3. The method according to claim 2 wherein the elastomeric outer layer of the pressure roller is made of Silastic E which has been ring-coated on a Viton surface to a thickness of approximately 0.001 inches.

4. The method according to claim 2 wherein said pressure roller also includes a relatively thick elastomeric base layer having a shore Å durometer in excess of 50.

5. The method according to claim 1 wherein said pressure roller includes an inner elastomeric base layer which is substantially thicker and harder than said outer layer.

6. The method according to claim 1 wherein both said pressure roller and said fusing roller have outside surfaces formed by the same materials.

7. A pressure roller usable in a fuser, said pressure roller comprising:

a metallic core, an elastomeric inner layer, and an elastomeric outer layer, the elastomeric inner layer being substantially thicker and harder than the elastomeric outer layer and the elastomeric outer layer having a shore Å durometer less than 40 and a surface roughness average of less than 40 microinches.

8. The pressure roller according to claim 7 wherein the outer layer has a shorn Å durometer of about 35 and a roughness average of about 10 microinches.

9. The pressure roller according to claim 7 wherein the inner elastomeric layer has a durometer of at least 50 shore Å.

10. The pressure roller according to claim 7 wherein the outer layer has a surface roughness average less than 20 microinches.

11. Image forming apparatus for producing duplex images on a receiving sheet, said apparatus comprising:

means for forming a toner image on one side of the receiving sheet, a fuser having a fusing roller and a pressure roller positioned to form a fusing nip, said pressure roller having an outside surface formed by an elastomeric layer having a shore Å durometer less than 40 and a surface roughness average less than 40 microinches peak-to-valley, means for feeding a receiving sheet having said first toner image on its first side from said image forming means to said fusing nip with the first image in contact with said fusing roller, means for circulating the receiving sheet from said fuser back to said forming means to receive a second image on the second side of the receiving sheet, and means for feeding said receiving sheet having both said first and second toner images on said first and second sides, respectively, from said forming means into said fusing nip with the second image in contact with said fusing roller and the first image in contact with the pressure roller.

12. Image forming apparatus according to claim 11 wherein the elastomeric outer surface of the pressure roller is provided by a layer of polydimethylsiloxane having titanium dioxide and silica fillers sufficient to provide a durometer of approximately 35 Shore A and a roughness average of about 10 microinches.

13. Image forming apparatus according to claim 12 wherein the elastomeric outer layer of the pressure roller is ring-coated to a thickness of approximately 0.001 inches.

14. Image forming apparatus according to claim 12 wherein said pressure roller also includes a relatively thick elastomeric base layer having a Shore A durometer in excess of 50.

15. Image forming apparatus according to claim 11 wherein said pressure roller includes an inner elastomeric base layer which is substantially thicker and harder than said outer layer.

16. Image forming apparatus according to claim 11 wherein both said pressure roller and said fusing roller have outer layers constructed of the same materials.

17. Image forming apparatus according to claim 16 wherein the fusing roller has an elastomeric base layer substantially thicker and harder than its outer layer.

18. Image forming apparatus according to claim 15 wherein the fusing roller has an inner elastomeric base layer thicker than the inner elastomeric base layer of the pressure roller and an outer layer of the same material as the outer layer of the pressure roller.

19. Image forming apparatus according to claim 18 wherein the pressure roller is sufficiently harder than the fusing roller and the nip formed by the rollers is curved in the same direction as the curve of the pressure roller.

20. Image forming apparatus according to claim 19 wherein the fusing roller is heated by at least one heating element which directly contacts the outside surface of the fusing roller.

* * * * *